US009153891B2

(12) United States Patent
Fujita et al.

(10) Patent No.: US 9,153,891 B2
(45) Date of Patent: Oct. 6, 2015

(54) TERMINAL AND CONNECTION STRUCTURE OF THE SAME

(71) Applicant: OMRON CORPORATION, Kyoto-shi, Kyoto (JP)

(72) Inventors: Hiroyuki Fujita, Okayama (JP); Hiroto Yonehara, Tottori (JP)

(73) Assignee: OMRON Corporation, Kyoto (JP)

( * ) Notice: Subject to any disclaimer, the term of this patent is extended or adjusted under 35 U.S.C. 154(b) by 188 days.

(21) Appl. No.: 13/791,739

(22) Filed: Mar. 8, 2013

(65) Prior Publication Data

US 2013/0273788 A1 Oct. 17, 2013

(30) Foreign Application Priority Data

Mar. 9, 2012 (JP) ..... 2012-053566

(51) Int. Cl.

| | |
|---|---|
| ***H01R 13/04*** | (2006.01) |
| ***H01H 1/58*** | (2006.01) |
| ***H01R 13/11*** | (2006.01) |
| *H01H 1/36* | (2006.01) |
| *H01R 12/71* | (2011.01) |
| *H01R 13/26* | (2006.01) |
| *H01R 13/64* | (2006.01) |
| *H01H 1/40* | (2006.01) |
| *H01H 13/52* | (2006.01) |

(52) U.S. Cl.

CPC ..... *H01R 13/04* (2013.01); *H01H 1/5866* (2013.01); *H01R 13/112* (2013.01); *H01H 1/365* (2013.01); *H01H 1/40* (2013.01); *H01H 13/52* (2013.01); *H01R 12/716* (2013.01); *H01R 13/26* (2013.01); *H01R 13/64* (2013.01)

(58) Field of Classification Search

CPC ..... H01R 13/04; H01R 12/716; H01R 13/26; H01R 13/64; H01R 13/112; H01H 1/365; H01H 1/5866; H01H 13/52; H01H 1/40

USPC ..... 200/284, 252; 439/884, 74–75, 439/357–358, 444, 682, 723, 631

See application file for complete search history.

(56) References Cited

U.S. PATENT DOCUMENTS

| | | | | |
|---|---|---|---|---|
| 3,955,869 | A * | 5/1976 | Licht | 439/218 |
| 4,605,277 | A * | 8/1986 | DeFilippis et al. | 439/682 |
| 4,813,881 | A | 3/1989 | Kirby | |
| 4,992,056 | A * | 2/1991 | Douty et al. | 439/83 |
| 5,788,539 | A | 8/1998 | Fedder | |

FOREIGN PATENT DOCUMENTS

| | | |
|---|---|---|
| DE | 4330390 | 3/1995 |
| DE | 100 61 112 A1 | 6/2001 |
| DE | 102008045810 | 3/2010 |
| EP | 1528631 | 10/2004 |

* cited by examiner

*Primary Examiner* — Edwin A. Leon
(74) *Attorney, Agent, or Firm* — Klarquist Sparkman, LLP

(57) ABSTRACT

The present invention is to provide a terminal capable of being reduced in size and a connecting holder of the same. The terminals protrude from a housing, and include a branch portion, a terminal section cut out from the branch portion toward a tip end of the terminal section in a longitudinal direction, and a bent portion adjacent to the tip end. By decreasing a distance from the bent portion to a tip end of the terminal, variations in length size to the tip end due to bending can be suppressed.

8 Claims, 10 Drawing Sheets

TERMINAL AND CONNECTION STRUCTURE OF THE SAME

BACKGROUND OF THE INVENTION

1. Technical Field

The present invention relates to a terminal used for an electronic device, particularly switchgear such as a relay and a switch, and a connection structure of the same.

2. Related Art

Conventionally, a terminal used for a switch and the like, for example, DE 10,061,112 A1 describes a terminal in which an insulation displacement terminal is used as an externally connecting terminal and a terminal on the side of a connecting holder passes through the insulation displacement terminal, so that the switch can be operated.

However, in the above terminal, in order to enhance contact reliability between the insulation displacement terminal and the terminal on the side of the connecting holder, a surface area of the insulation displacement terminal is increased. Therefore, the insulation displacement terminal runs over an outer surface of an electronic device, and there is a problem that the electronic device cannot be reduced in size.

SUMMARY

The present invention has been devised to solve the above problem, and an object thereof is to provide a small terminal capable of being reduced in size, and a connection structure of the same.

In accordance with one aspect of the present invention, in a terminal according to the present invention, a terminal section of the terminal is cut out from a branch portion toward a tip end of the terminal section in the longitudinal direction, and includes a bent portion position closer on the tip end.

According to the present invention, since the terminal section is bent on the tip end side from the branch portion, a distance from a base portion of the terminal to a bent portion is increased. Therefore, the terminal is easily held at the time of bending processing of the later step, so that variations in processing precision of the terminal at the time of the bending processing are reduced.

By decreasing a distance from the bent portion to a tip end of the terminal, variations in length size to the tip end due to bending can be suppressed.

Further, the terminal section is formed by cutting out in the longitudinal direction and bending. Therefore, width size of the terminal section can be formed in such a manner that the terminal section does not protrude out from an outer circumferential surface of a housing, and even for a switch installed in the direction in which a push button is horizontally operated, the terminal section can be connected to connection terminals from two directions.

As an embodiment of the present invention, a width of the base portion of the terminal section may be narrower than the branch portion.

According to the above configuration, the terminal section is easily deformed at the time of inserting the connected terminals. Therefore, there is an advantage that an influence of deformation on a part which is influential on a contact operation can be suppressed to minimum, and hence an adverse influence on airtightness of a main body of the housing and operation characteristics can be minimized.

As a different embodiment of the present invention, the terminal may include the narrow base portion, the branch portion, whose width is wider than width of the base portion, extending from the base portion, the bent portion bent from the branch portion, and a pair of nipping portions extending from the bent portion, and a distance from the base portion to the bent portion may be longer than a distance from the bent portion to tip ends of the nipping portions.

Thereby, the terminal section can be bent on the tip end side, so that the variations in the processing precision of the terminal and the variations in the length size to the tip end due to the bending can be suppressed.

As a different embodiment of the present invention, a tip end of the terminal section may be arranged so as to be in a same plane with an outer periphery circumferential surface of the housing.

Thereby, since the housing can be pressed by simultaneously pushing the housing and the tip end of the terminal section by a flat jig, workability at the time of press-fitting can be improved.

As another embodiment of the present invention, the terminal section may be inserted into an acceptance side of connection terminals in a manner that the terminal section enters the connection terminals from the bent portion into and nipped by the connected terminals protruding on an inward surface of a connecting holder which has an opening at least in one direction.

Thereby, a height of the connected terminals can be decreased. At the time of sealing a circumference of the terminal section with an insulating resin, the circumference can be sealed with a small amount of resin.

As still another embodiment of the present invention, the terminal section may be inserted from the nipping portions into and nipped by the connected terminals protruding on an inward surface of a connecting holder which has an opening at least in one direction.

Thereby, the terminal can be connected to the connecting holder by various methods.

A positioning projection section provided on the outer circumferential surface of the housing may be fitted into an insertion hole formed on the inward surface.

Thereby, the housing is easily positioned on the connecting holder, so that the workability at the time of press-fitting the housing into the connecting holder is improved. Since the housing is fixed to the connecting holder via the positioning projection section, contact reliability between the terminal section and the connected terminal can be maintained.

BRIEF DESCRIPTION OF THE DRAWINGS

FIG. 2B is an exploded perspective view in which FIG. 2A is seen from the lower side;

FIG. 3B is a perspective view in which FIG. 3A is seen from a different direction;

FIG. 9 is a plan view in which FIG. 8 is seen from the upper side;

FIG. 15 is a plan view in which FIG. 14 is seen from the upper side.

DETAILED DESCRIPTION

Embodiments of a switch according to the present invention will be described in accordance with FIGS. 1 to 15.

First Embodiment

Figure 1:
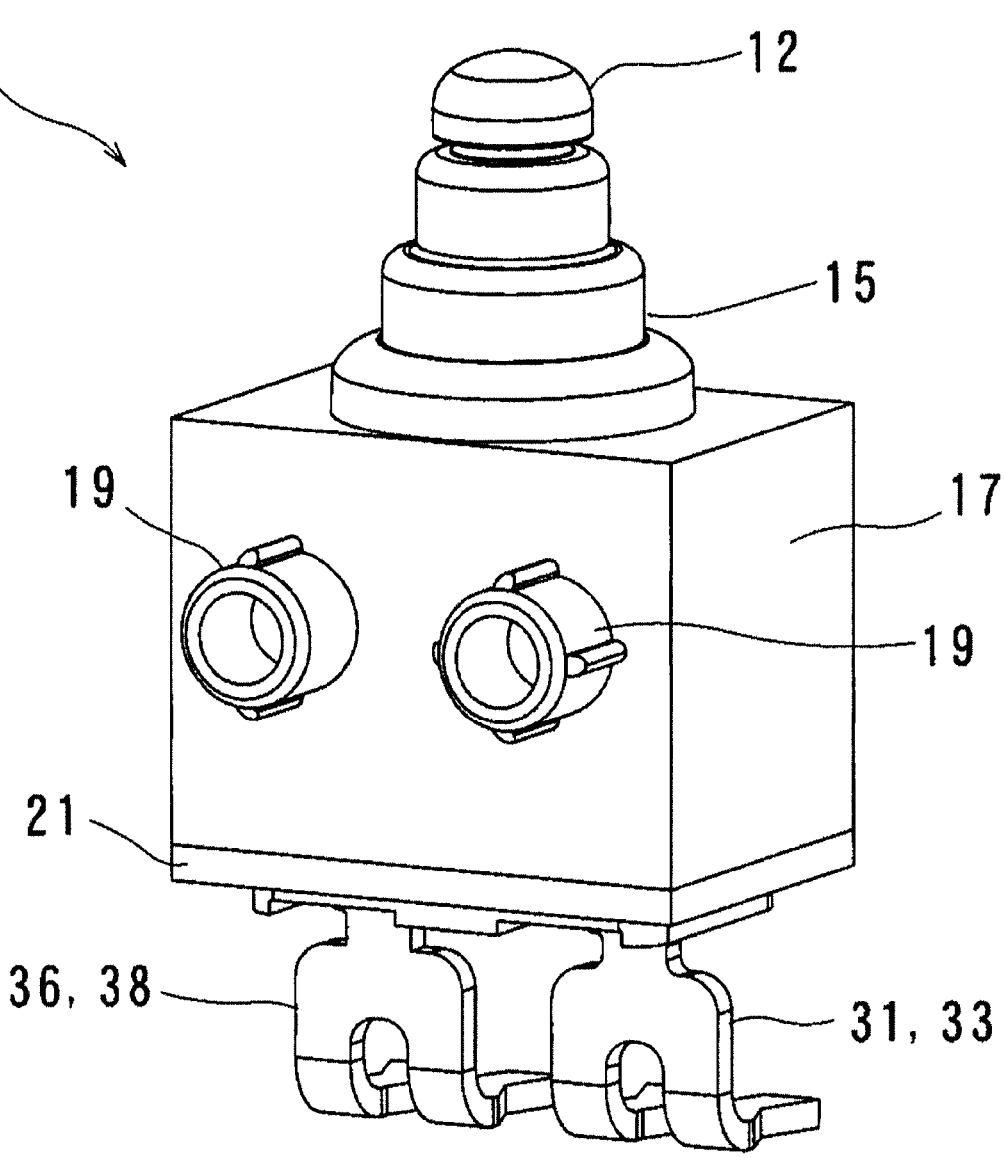
FIG. 1 is a perspective view showing a switch provided with terminals according to a first embodiment of the present invention.
Figure 2A:
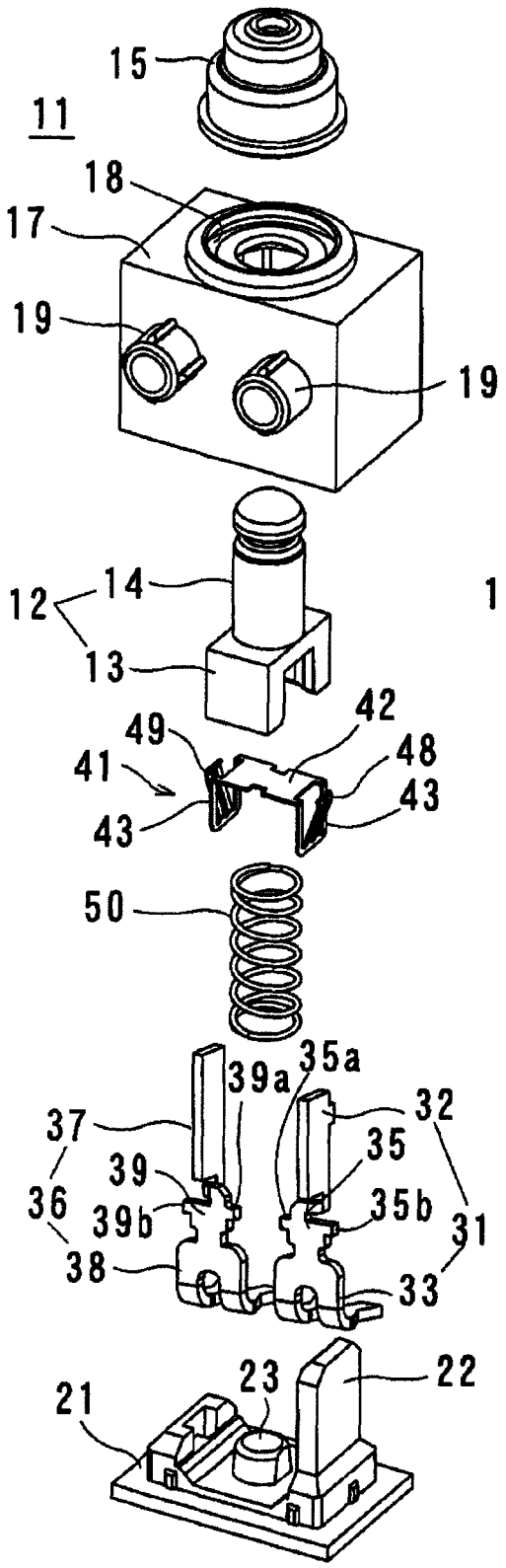
FIG. 2A is an exploded perspective view in which the switch of FIG. 1 is seen from the upper side.
Figure 2B:
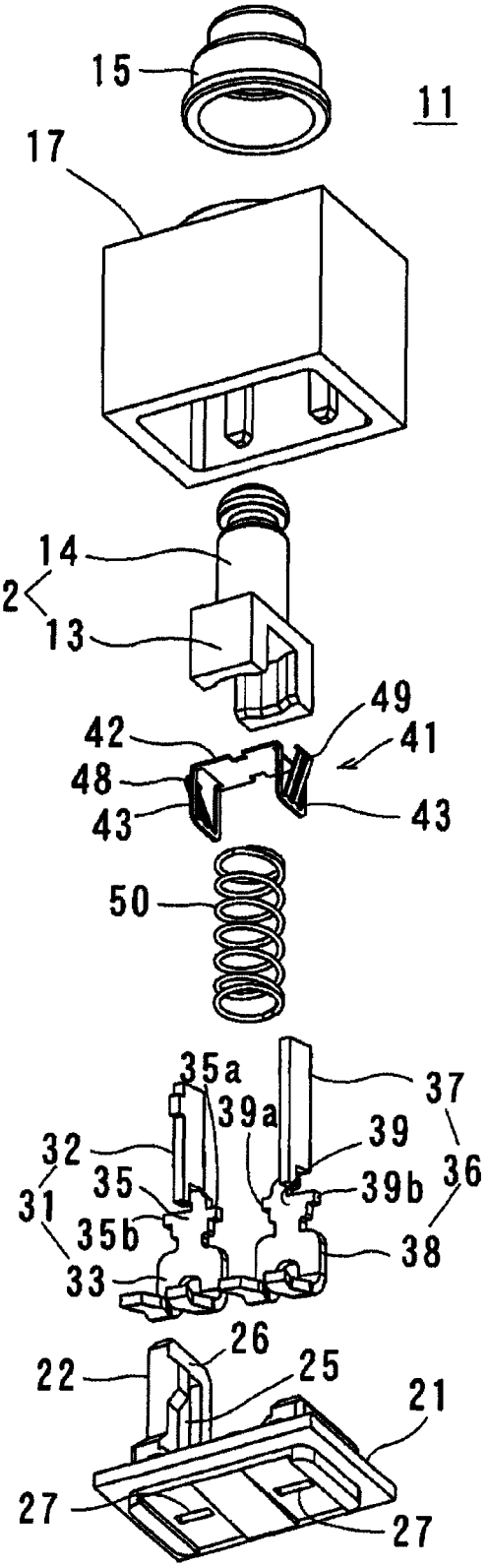

A switch 11 provided with terminals 33, 38 according to a first embodiment includes a push button 12, a casing (housing) 17, a base 21, a first fixing terminal 31, a second fixing terminal 36, and a slider 41 as shown in FIGS. 1, 2A, and 2B.

The push button 12 has a seat 13 in which a recessed portion is formed, and a cylindrical pressed section 14 extending upward from the seat 13 in the axial direction. The push button 12 is arranged inside the casing (housing) 17 movably in the axial direction orthogonal to the base 21, and an upper end of the pressed section 14 protrudes upward from the casing (housing) 17 through a cylindrical cap 15. Therefore, the pressed section 14 is pressed from an exterior, so that the push button 12 is moved in the axial direction.

The housing 17 is formed in a box shape in which a bottom portion is opened, and has an annular groove 18 formed on an upper surface thereof, the annular groove through which the pressed section 14 of the push button 12 is inserted, and a pair of annular positioning projection sections 19 horizontally protruding from a side surface thereof.

The base 21 is a plate shape resin body for closing an opening in the bottom portion of the housing 17. In the base 21, an insulating wall section 22 extending upward is integrally formed on an upper surface thereof, and a cylindrical rib 23 protruding upward is provided in a center of the base 21. The insulating wall section 22 includes a burying groove 25 formed in a rectangular shape in a front view and provided on an inner surface thereof, the burying groove into which the first fixing terminal 31 is buried, and an insulation portion 26 provided on the upper side of the burying groove 25. Further, terminal holes 27 through which the first fixing terminal 31 and the second fixing terminal 36 are inserted are formed in the base 21.

The first fixing terminal 31 is made of metal, and has a rectangular plate shape first slide contact section 32 formed in an upper half part thereof extending in the axial direction, and a first externally connecting terminal section 33 formed in a lower half part thereof. The first externally connecting terminal section 33 is formed in an L shape, and bent so as to be orthogonal to the axial direction on the opposite side of the protruding direction of the positioning projection sections 19 of the housing 17.

Figure 3A:
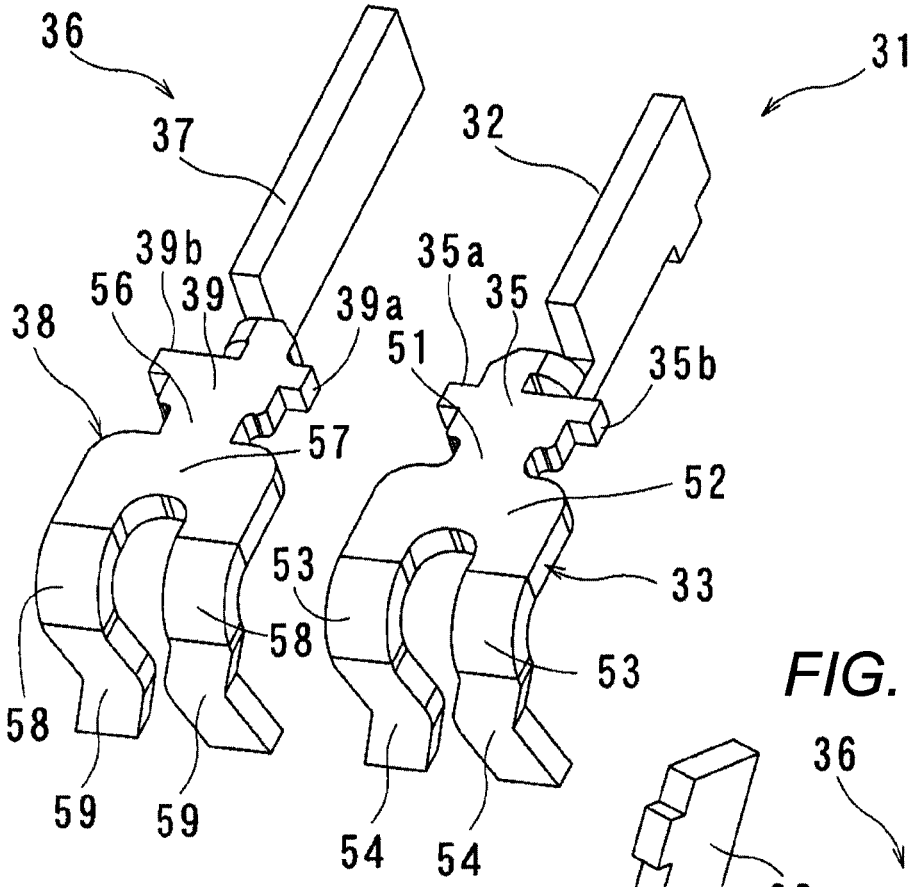
FIG. 3A is an enlarged perspective view of a first fixing terminal and a second fixing terminal of FIGS. 2A and 2B.
Figure 3B:
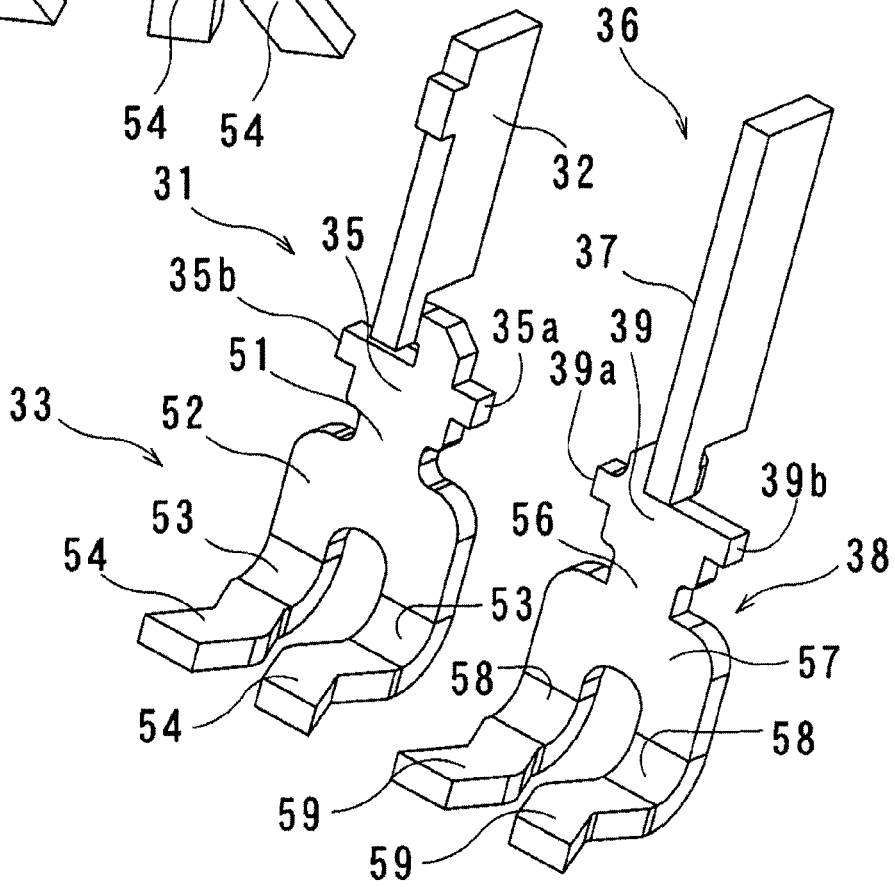
Figure 4:
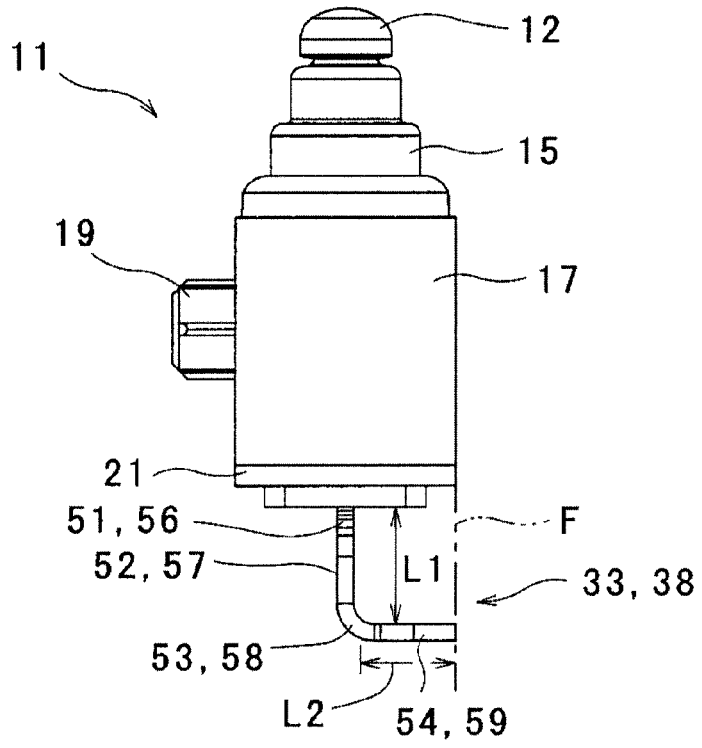
FIG. 4 is a side view of the switch of FIG. 1.

The first externally connecting terminal section 33 has a base portion 51, a branch portion 52, bent portions 53, and a pair of nipping portions 54 as shown in FIGS. 3A and 3B. The base portion 51 continues to the first slide contact section 32 via a coupling section 35, and is formed to be narrow. The branch portion 52 extends from the base portion 51 on the opposite side of the first slide contact section 32, and is formed to be wide. The first externally connecting terminal section 33 is cut out from the branch portion 52 toward a tip end. Further, the bent portions 53 are placed on the tip end side of the branch portion 52 and placed on the tip end side of a longitudinal center of the first externally connecting terminal section 33, and bent so as to be orthogonal to the branch portion 52. The pair of nipping portions 54 extends from the bent portions 53 and nips a connection fitting 67 (connected terminal, refer to FIG. 5) described later.

The first slide contact section 32 and the first externally connecting terminal section 33 are coupled so as to be orthogonal to each other. A first inward projection 35*a*, and a first outward projection 35*b* protruding on the opposite side of the first inward projection 35*a* are formed in the coupling section 35. In a state that the first fixing terminal 31 is fixed to the base 21 via the terminal hole 27, the first slide contact section 32 is buried in the burying groove 25 so as to be flush with the insulation portion 26 and brought into sliding contact with the slider 41 moved in the axial direction. Meanwhile, the first externally connecting terminal section 33 is exposed downward from the terminal hole 27 and connected to the connection fitting 67.

The second fixing terminal 36 is made of metal, and has a rectangular plate shape second slide contact section 37 formed in an upper half part thereof extending in the axial direction, and a second externally connecting terminal section 38 formed in a lower half part thereof. The second externally connecting terminal section 38 is formed in an L shape, and bent so as to be orthogonal to the axial direction on the opposite side of the protruding direction of the positioning projection sections 19 of the housing 17.

The second externally connecting terminal section 38 has a base portion 56, a branch portion 57, bent portions 58, and a pair of nipping portions 59. The base portion 56 continues to the second slide contact section 37 via a coupling section 39, and is formed to be narrow. The branch portion 57 extends from the base portion 56 on the opposite side of the second slide contact section 37, and is formed to be wide. The second externally connecting terminal section 38 is cut out from the branch portion 57 toward a tip end. Further, the bent portions 58 are placed on the tip end side of the branch portion 57 and placed on the tip end side of a longitudinal center of the second externally connecting terminal section 38, and bent so as to be orthogonal to the branch portion 57. The pair of nipping portions 59 extends from the bent portions 58 and nips a connection fitting 67 (refer to FIG. 5) described later.

The second slide contact section 37 and the second externally connecting terminal section 38 are coupled so as to be orthogonal to each other. A second inward projection 39*a*, and a second outward projection 39*b* protruding on the opposite side of the second inward projection 39*a* are formed in the coupling section 39. The second slide contact section 37 is formed to be longer than the first slide contact section 32 of the first fixing terminal 31. In a state that the second fixing terminal 36 is fixed to the base 21 via the terminal hole 27, the second slide contact section 37 is always in contact with the slider 41. Meanwhile, the second externally connecting terminal section 38 is exposed downward from the terminal hole 27 and connected to the connection fitting 67.

According to the above configuration, the first externally connecting terminal section 33 and the second externally connecting terminal section 38 are bent on the tip end side thereof. Thus, a distance L1 from the base portions 51, 56 to the bent portions 53, 58 is longer than a distance L2 from the bent portions 53, 58 to tip ends of the nipping portions 54, 59 (refer to FIG. 4). Since the distance L1 from the base portions 51, 56 to the bent portions 53, 58 is longer, the externally connecting terminal sections 33, 38 are easily held at the time of bending processing of the later step, so that variations in processing precision of the terminals at the time of the bending processing are reduced. Since the distance L2 from the bent portions 53, 58 to the tip ends of the nipping portions 54, 59 is shorter, variations in length size to the tip ends due to bending can be suppressed. Further, since the externally connecting terminal sections 33, 38 are formed by cutting out in the longitudinal direction and bending, width size of the externally connecting terminal sections 33, 38 can be reduced smaller than an outside width of the switch 11 in comparison to the conventional example. For the switch 11 installed in the direction in which the push button 12 is horizontally operated, the connection fittings 67 can be inserted into the externally connecting terminal sections 33, 38 from two up and down directions.

The slider 41 has a plate shape coupling body 42, and elastic arm sections 43 formed by bending both ends of the coupling body 42. Movable contact portions 48, 48 to be brought into sliding contact with the insulation portion 26 of the insulating wall section 22 or the first fixing terminal 31, and movable contact portions 49, 49 to be brought into sliding contact with the second fixing terminal 36 are formed in tip ends of the elastic arm sections 43.

Next, an assembling method of the switch 11 including the above constituent members will be described.

Firstly, the cap 15 is fitted into the annular groove 18 of the housing 17. The push button 12 is inserted inside the housing 17 movably in the axial direction, so that the upper end of the pressed section 14 protrudes from the cap 15. It should be noted that in advance, the slider 41 is fixed to the recessed portion of the seat 13 of the push button 12 by insert-molding, thermal caulking, or snap-fitting. After that, an upper end of a coil spring 50 is abutted with the recessed portion of the seat 13.

The first fixing terminal 31 is insert-molded to the base 21 in advance so that the first inward projection 35*a* and the first outward projection 35*b* of the first fixing terminal 31 are buried in the base 21. At this time, the first slide contact section 32 of the first fixing terminal 31 is buried in the burying groove 25 of the insulating wall section 22 so as to be flush with the insulation portion 26 (refer to FIG. 10A). Therefore, the slider 41 can be brought into smooth sliding contact with the insulation portion 26 and the first fixing terminal 31. Similarly, the second fixing terminal 36 is insert-molded to the base 21 in advance so that the second inward projection 39*a* and the second outward projection 39*b* of the second fixing terminal 36 are buried in the base 21.

Further, the base 21 is installed in the opening of the housing 17 so that the cylindrical rib 23 of the base 21 is engaged with a lower end of the coil spring 50 so as to compress the coil spring 50, and the first fixing terminal 31 and the second fixing terminal 36 are accommodated inside the housing 17. Thereby, the switch 11 is completed. When the switch 11 is completed, tip end positions of the first externally connecting terminal section 33 and the second externally connecting terminal section 38, that is, ends of the nipping portions 54, 59 match with a plane F extending from an outside form of the housing 17 (refer to FIG. 4).

Figure 5:
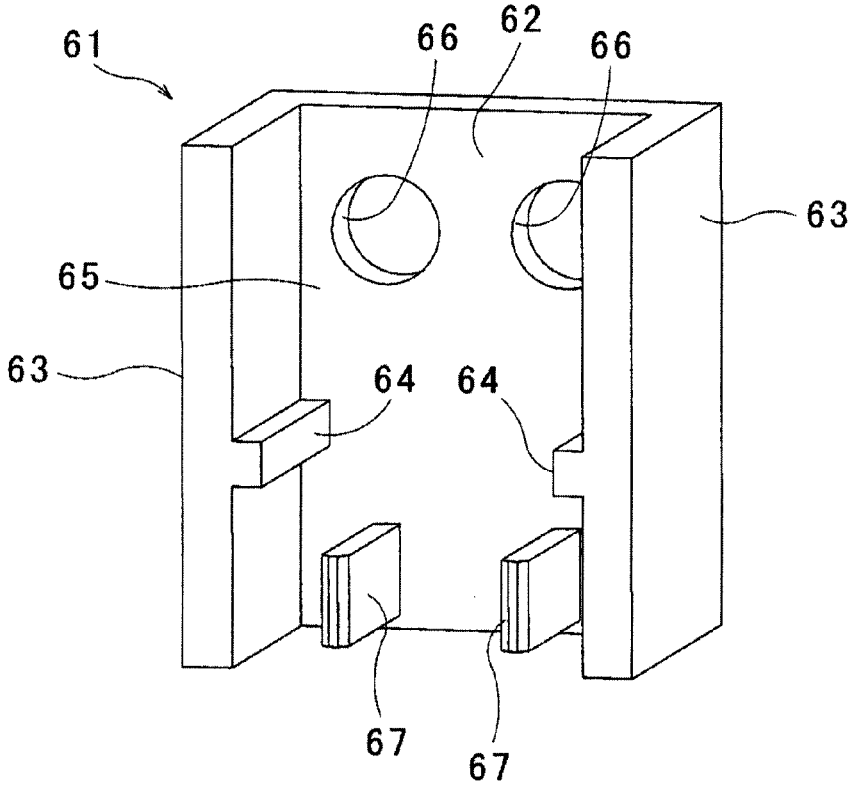
FIG. 5 is a perspective view showing a connecting holder into which the switch of FIG. 1 is press-fitted.

The assembled switch 11 is press-fitted into a connecting holder 61 shown in FIG. 5. The connecting holder 61 has for example a substrate 62, and a pair of side plates 63 vertically standing up from both edges of the substrate 62 and facing each other. On inner surfaces of the side plates 63, linear ribs 64 protruding inward are formed. In the connecting holder 61, a press-fit section 65 into which the switch 11 is press-fitted is partitioned by the linear ribs 64. A pair of circular insertion holes 66 is formed in the substrate 62 of the press-fit section 65. In an end facing the circular insertion holes 66 of the substrate 62 across the linear ribs 64, the pair of connection fittings 67 is provided in line.

Figure 6:
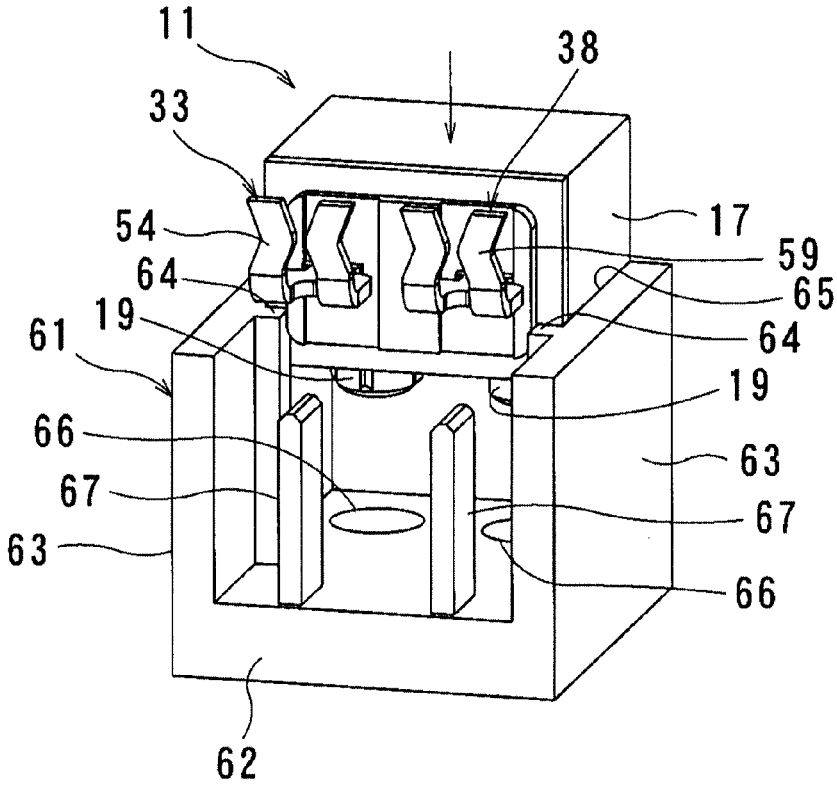
FIG. 6 is a perspective view showing a state before the switch is press-fitted into the connecting holder of FIG. 5.

In order to press-fit the switch 11 into the connecting holder 61, as shown in FIG. 6, the housing 17 of the switch 11 is positioned to the press-fit section 65 of the connecting holder 61 and press-fitted downward. At this time, the tip end positions of the first externally connecting terminal section 33 and the second externally connecting terminal section 38 match with the plane F extending from the outside form of the housing 17 (refer to FIG. 4). Therefore, by simultaneously pushing the housing 17 and tip ends of the externally connecting terminal sections 33, 38 by a flat jig, the switch 11 can be press-fitted into the connecting holder 61. Thus, workability at the time of press-fitting can be improved.

Figure 7:
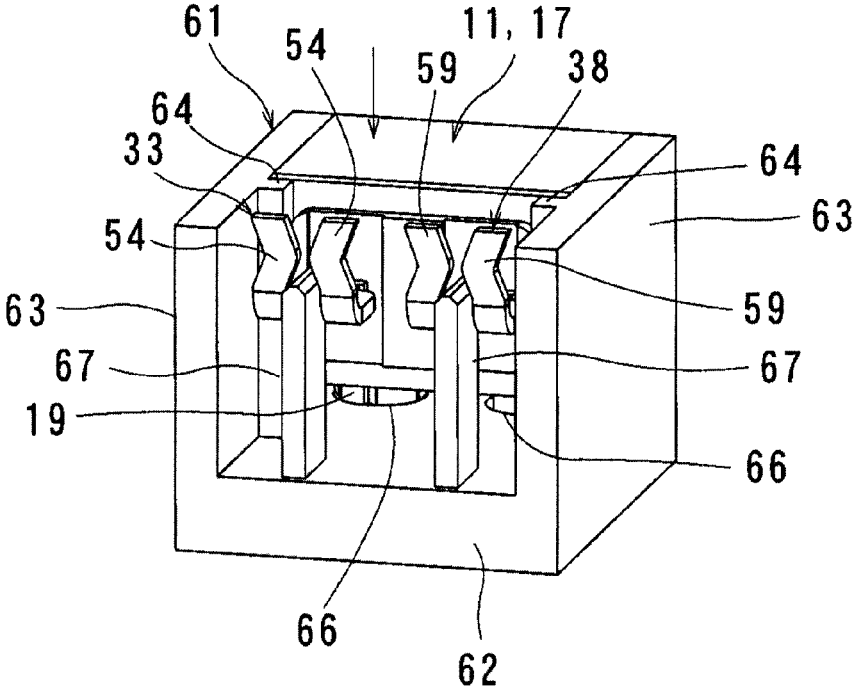
FIG. 7 is a perspective view showing a state that positioning projection sections of the switch are fitted into insertion holes of the connecting holder and the terminals are press-fitted into connection fittings.
Figure 8:
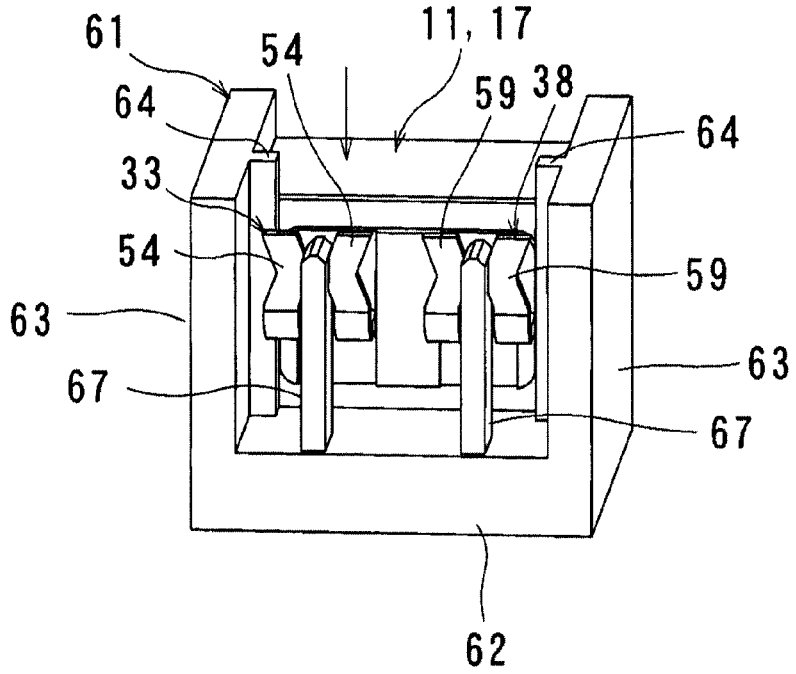
FIG. 8 is a perspective view showing a state that fitting of the positioning projection sections into the insertion holes is completed and press-fitting of the terminals into the connection fittings is completed.
Figure 9:
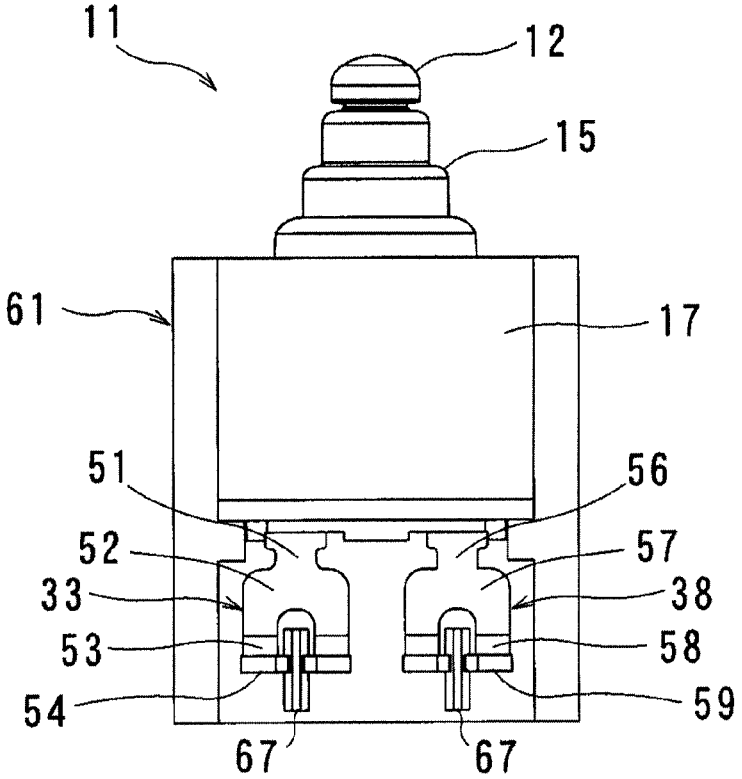

As shown in FIG. 7, the positioning projection sections 19 of the switch 11 are fitted into the circular insertion holes 66 of the connecting holder 61. Thereby, the housing 17 is easily positioned to the connecting holder 61, so that the workability at the time of press-fitting the housing 17 into the connecting holder 61 is improved. Since the housing 17 is fixed to the connecting holder 61 via the positioning projection sections 19, contact reliability between the first externally connecting terminal section 33 and the second externally connecting terminal section 38 and the connection fittings 67 can be maintained. When the positioning projection sections 19 are fitted into the circular insertion holes 66, the connection fittings 67 are guided between the nipping portions 54, 59 so that the connection fittings 67 are nipped by the nipping portions 54, 54 of the first externally connecting terminal section 33 and the nipping portions 59, 59 of the second externally connecting terminal section 38. As shown in FIG. 8, by sliding and nipping the connection fittings 67 between the nipping portions 54, 59, the first externally connecting terminal section 33 and the second externally connecting terminal section 38 are connected to the connection fittings 67, so that assembling of the switch 11 to the connecting holder 61 is completed. At this time, as shown in FIG. 9, when the connection fittings 67, and the branch portions 52, 57 and the nipping portions 54, 59 are projected on the same plane, ends of the connection fittings 67 are placed between the branch portions 52, 57 and the nipping portions 54, 59. Thus, even when the switch 11 of FIG. 6 is turned over, the externally connecting terminal sections 33, 38 can be press-fitted into the connection fittings 67.

It should be noted that the base portions 51, 56 are formed to be narrow. Thus, when the switch 11 is assembled to the connecting holder 61, the externally connecting terminal sections 33, 38 are easily deformed at the time of inserting the connection fittings 67 into the nipping portions 54, 59. Therefore, there is an advantage that an influence on a part which is influential on a contact operation can be suppressed to minimum, and hence an adverse influence on airtightness of a main body of the switch and operation characteristics can be suppressed. It should be noted that the connecting holder 61 is not limited to the above configuration but only required to have a positioning mechanism for press-fitting the externally connecting terminal sections 33, 38 into the connection fittings 67 protruding from the connecting holder 61.

Next, operations of the switch 11 will be described.

Figure 10A:
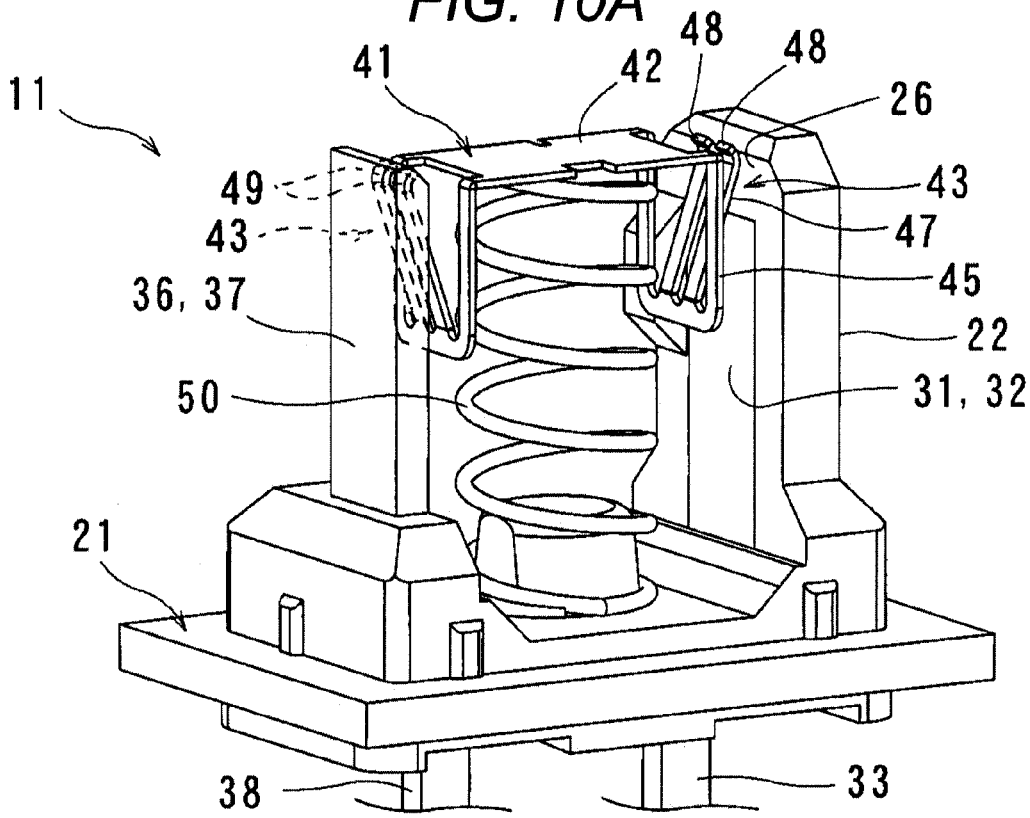
FIG. 10A is a perspective view showing a relationship between a slider and the first fixing terminal in a state that the switch adopting an always-open contact structure is at an initial position.
Figure 10B:
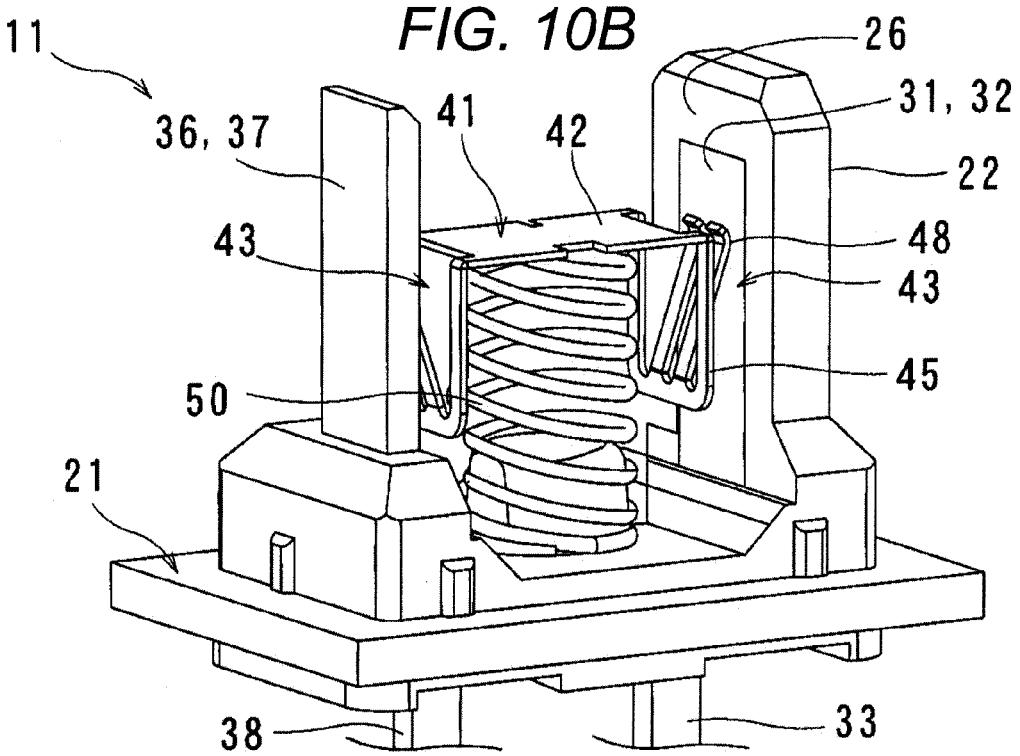
FIG. 10B is a perspective view corresponding to FIG. 10A in which the switch is at an operation position.
Figure 11:
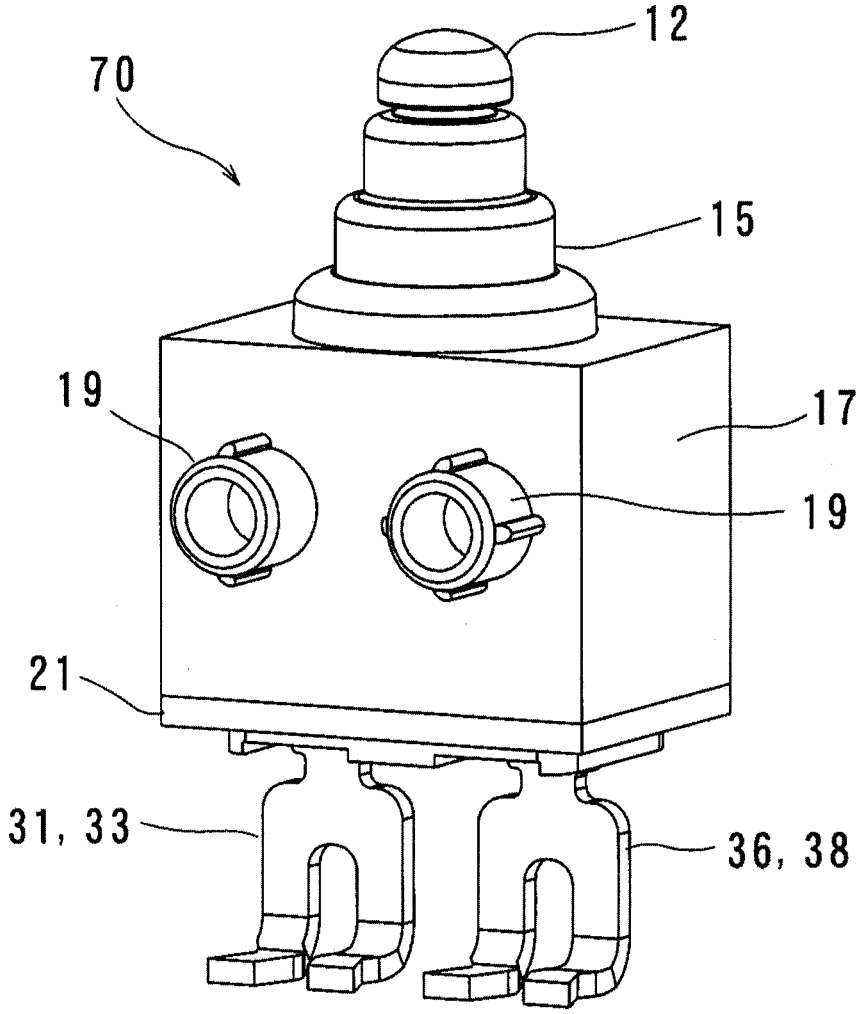
FIG. 11 is a perspective view showing a switch provided with terminals according to a second embodiment of the present invention.

When the switch 11 is assembled, as shown in FIG. 10A, the slider 41 is biased by the coil spring 50 and placed at an initial position on the upper side. At this time, the movable contact portions 48, 48 on the one side are abutted with the insulation portion 26 of the insulating wall section 22, and the movable contact portions 49, 49 on the other side are abutted with the second slide contact section 37 of the second fixing terminal 36, so that the switch is insulated. When the pressed section 14 of the push button 12 is pressed from the exterior in this state, the push button 12 is moved with the slider 41 downward in the axial direction against a bias force of the coil spring 50. Therefore, in the slider 41, the elastic arm sections 43 are moved downward, and brought into sliding contact with the first slide contact section 32 of the first fixing terminal 31 after the insulation portion 26. When the slider reaches an operation position shown in FIG. 10B, the movable contact portions 48, 48 on the one side are abutted with the first slide contact section 32 and the movable contact portions 49, 49 on the other side are abutted with the second slide contact section 37, so that the switch is conducted. Thereby, the connection fittings respectively connected to the first and second externally connecting terminal sections 33, 38 are brought into a conduction state. When a pressing force of the push button 12 toward the pressed section 14 is cancelled, the push button 12 is moved with the slider 41 upward in the axial direction by the bias force of the coil spring 50. Therefore, in the slider 41, the elastic arm sections 43 are moved upward, brought into sliding contact with the insulation portion 26 after the first slide contact section 32, and returned to the initial position. As a result, the movable contact portions 48, 48 on the one side are abutted with the insulation portion 26 of the insulating wall section 22, and the movable contact portions 49, 49 on the other side are abutted with the second slide contact section 37, so that the switch is brought into a non-conducting state.

Second Embodiment

In the first embodiment, the first externally connecting terminal section 33 and the second externally connecting terminal section 38 are bent in the opposite direction to the protruding direction of the positioning projection sections 19 of the housing 17. However, the present invention is not limited to this. For example, as in a switch 70 according to a second embodiment shown in FIG. 11, a base 21 to which a first externally connecting terminal section 33 and a second externally connecting terminal section 38 are insert-molded is rotated by 180° and installed in a housing 17. Thereby, the first externally connecting terminal section 33 and the second externally connecting terminal section 38 are bent in the same direction as the protruding direction of positioning projection sections 19. Apart from this point, the second embodiment is the same as the first embodiment. Thus, the same parts will be given the same reference numerals and description thereof will not be repeated.

Figure 12:
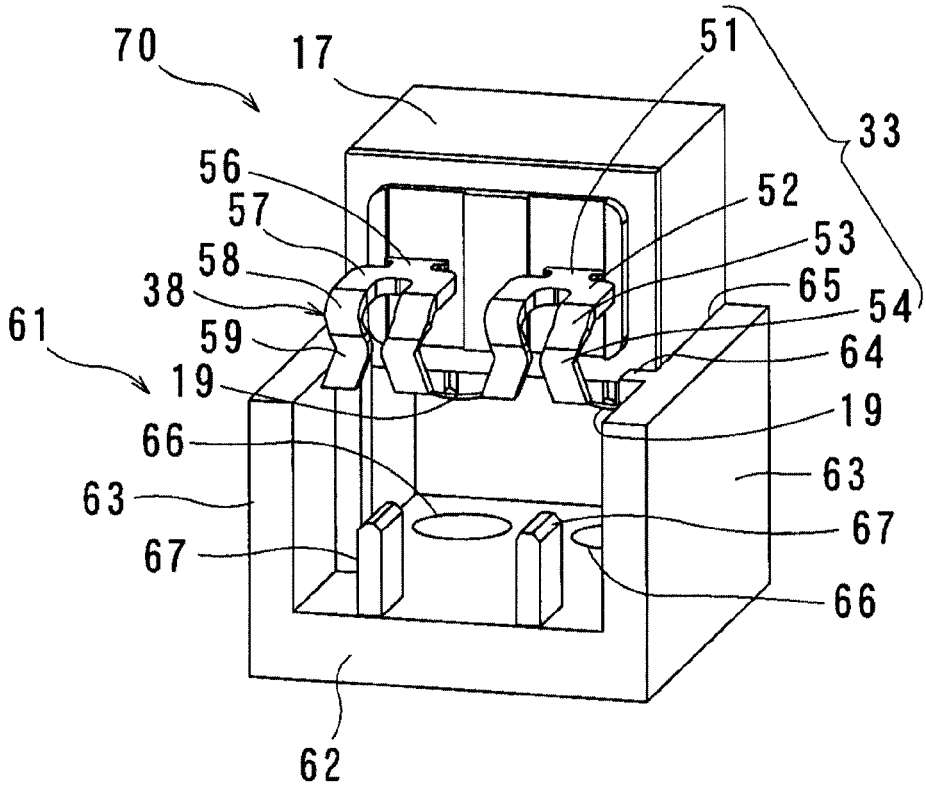
FIG. 12 is a perspective view showing a state before the switch is press-fitted into a connecting holder.
Figure 13:
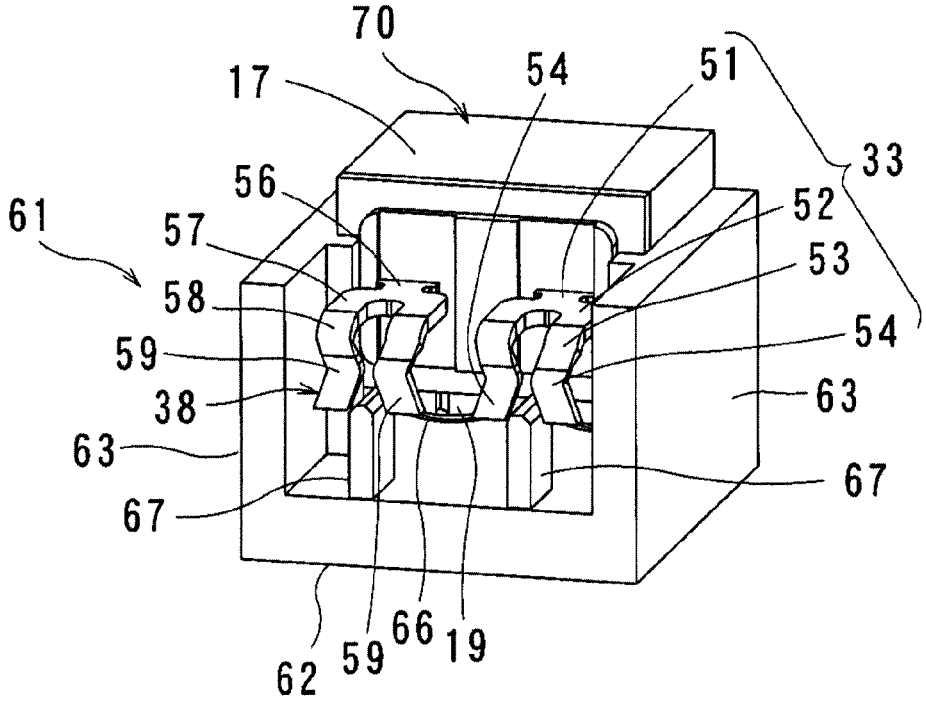
FIG. 13 is a perspective view showing a state that positioning projection sections of the switch are fitted into insertion holes of the connecting holder and the terminals are press-fitted into connection fittings.
Figure 14:
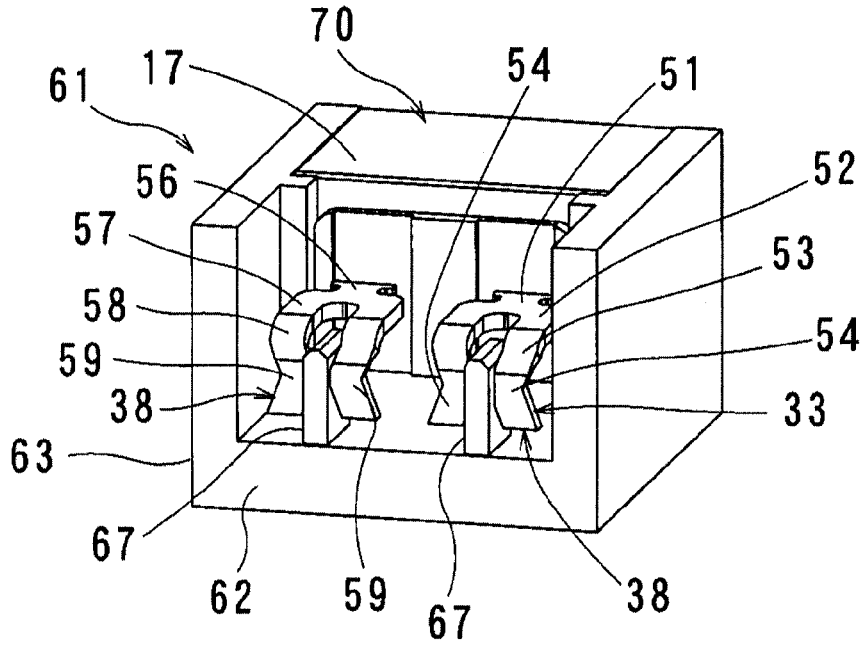
FIG. 14 is a perspective view showing a state that fitting of the positioning projection sections into the insertion holes is completed and press-fitting of the externally connecting terminals into the connection fittings is completed.
Figure 15:
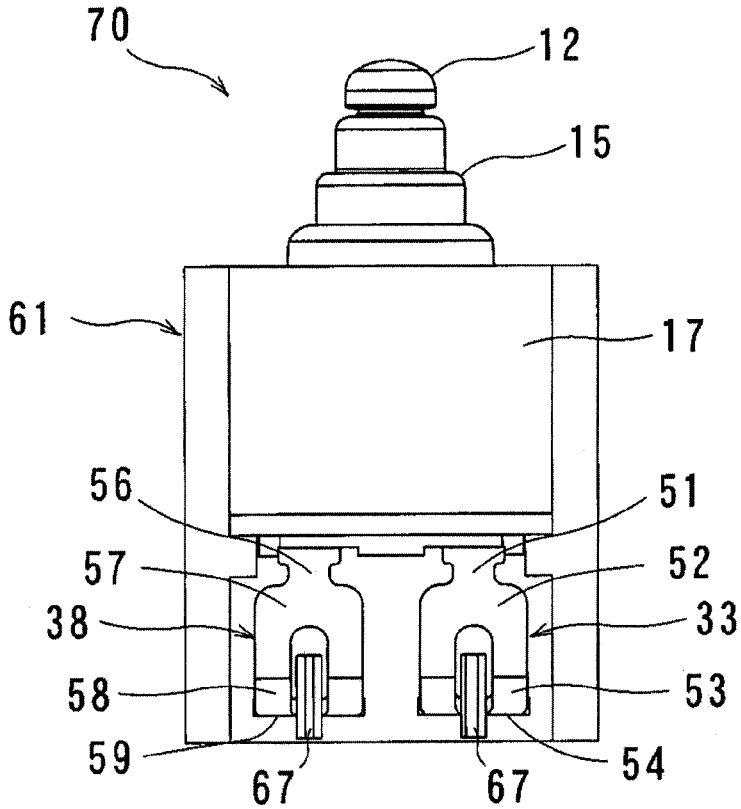

In order to press-fit the switch 70 into a connecting holder 61, as shown in FIG. 12, the housing 17 of the switch 70 is positioned to a press-fit section 65 of the connecting holder 61 and press-fitted downward. As shown in FIG. 13, the positioning projection sections 19 of the switch 70 are guided and fitted into circular insertion holes 66 of the connecting holder 61. At this time, connection fittings 67 are guided between nipping portions 54, 59 so that the connection fittings 67 are nipped by the nipping portions 54, 54 of the first externally connecting terminal section 33 and the nipping portions 59, 59 of the second externally connecting terminal section 38. As shown in FIG. 14, by sliding and nipping the connection fittings 67 between the nipping portions 54, 59, the first externally connecting terminal section 33 and the second externally connecting terminal section 38 are connected to the connection fittings 67, so that assembling of the switch 70 to the connecting holder 61 is completed. Since the first externally connecting terminal section 33 and the second externally connecting terminal section 38 are bent in the same direction as the protruding direction of the positioning projection sections 19, a height of the connection fittings 67 can be decreased. At the time of sealing circumferences of the first externally connecting terminal section 33 and the second externally connecting terminal section 38 with an insulating resin, the circumferences can be sealed even with a small amount of resin. As shown in FIG. 15, when the connection fittings 67, and branch portions 52, 57 and the nipping portions 54, 59 are projected on the same plane, ends of the connection fittings 67 are placed between the branch portions 52, 57 and the nipping portions 54, 59. Thus, even when the switch 70 of FIG. 12 is turned over, the connection fittings 67 can be press-fitted into the externally connecting terminal sections 33, 38. It should be noted that the connecting holder 61 is not limited to the above configuration but only required to have a positioning mechanism for press-fitting the externally connecting terminal sections 33, 38 into the connection fittings 67 protruding from the connecting holder 61.

It should be noted that the terminals of the present invention may be adopted for any of a fixed contact and a movable contact of an electric device such as a relay and a switch as a matter of course.

There has thus been shown and described a terminal and connection structure of the same which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A terminal comprising:

a base portion;

a branch portion extending from said base portion, said base portion having a width narrower than the branch portion;

a terminal section cut out from the branch portion toward a tip end of the terminal section in a longitudinal direction;

a bent portion disposed adjacent to the tip end; and a connecting holder having an opening in at least one direction and including connection fittings protruding from an inner surface of said connecting holder;

wherein the terminal section is insertable into said connecting holder in a manner that the terminal section enters the connection fittings from the bent portion or an extension from the bent portion, and press-fits the connection fittings.

2. The terminal according to claim 1, wherein the extension is a nipping portion extending from the bent portion and having a nipping portion tip end, and wherein a distance from the base portion to the bent portion is longer than a distance from the bent portion to the nipping portion tip end.

3. The terminal according to claim 1, wherein the tip end of the terminal section is arranged so as to be in a same plane as an outer periphery circumferential surface of a housing for the terminal.

4. The terminal according to claim 2, wherein the tip end of the terminal section is arranged so as to be in a same plane as an outer periphery circumferential surface of a housing for the terminal.

5. The terminal according to claim 2, wherein the terminal section is insertable into said connecting holder in a manner that the terminal section enters the connection fittings from the nipping portion, and press-fits the connection fittings.

6. The terminal according to claim 5, further comprising: a housing having a positioning projection section on an outer circumferential surface of the housing configured for insertion into an insertion hole formed on an inner surface of said connecting holder.

7. The terminal according to claim 2, further comprising a housing having a positioning projection section on an outer circumferential surface of the housing configured for insertion into an insertion hole formed on an inner surface of said connecting holder.

8. The terminal according to claim 3, wherein the terminal section is insertable into said connecting holder in a manner that the terminal section enters the connection fittings from the nipping portion, and press-fits the connection fittings.

* * * * *